US009718183B2

(12) United States Patent
Ou

(10) Patent No.: US 9,718,183 B2
(45) Date of Patent: Aug. 1, 2017

(54) DISPLAY BOARD

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 112 days.

(21) Appl. No.: 14/790,903

(22) Filed: Jul. 2, 2015

(65) Prior Publication Data

US 2017/0001298 A1 Jan. 5, 2017

(51) Int. Cl.
*B25H 3/00* (2006.01)

(52) U.S. Cl.
CPC ..... *B25H 3/003* (2013.01)

(58) Field of Classification Search
CPC ..... B25H 3/003; B25B 13/56
USPC ..... 206/372, 378, 493, 376, 377, 375, 373, 206/806, 807, 1.5, 349; 211/70.6, 69.5, 211/69
See application file for complete search history.

(56) References Cited

U.S. PATENT DOCUMENTS 6,508,360 B1 * 1/2003 Chen ..... B25H 3/003 206/349
8,556,075 B1 * 10/2013 Ou ..... B65D 73/0064 206/372
8,800,767 B2 * 8/2014 Wang ..... B25H 3/00 206/372
D771,945 S * 11/2016 Ou ..... D3/315

FOREIGN PATENT DOCUMENTS

TW M435978 8/2012

* cited by examiner

*Primary Examiner* — Andrew Perreault
(74) *Attorney, Agent, or Firm* — Muncy, Geissler, Olds & Lowe, P.C.

(57) ABSTRACT

A display board is provided, for assembling of at least one socket thereto. The display board includes a main body and a cover member. The main body is formed with a slot. The slot is open to form an open side. The main body further includes at least one assembling portion for the at least one socket to assemble thereto and a hang portion. The cover member is connected with the main body at the open side and encloses the open side. The cover member and the main body construct an annular profile. Two opposite ends of the open side are formed with two engaging slots. Two opposite ends of the cover member are formed with two ear portions. The two ear portions are engaged respectively with the two engaging slots. The cover member is for the at least one socket to abut thereagainst.

8 Claims, 4 Drawing Sheets

DISPLAY BOARD

BACKGROUND OF THE INVENTION

Field of the Invention

The present invention relates to a display board, and more particularly to a display board for socket.

Description of the Prior Art

A prior art of a display board is disclosed in TW M435978. It mainly includes a hang member, a positioning member and a limiting member. The positioning member includes a main body, a base body, a spring plate and a protrusion. The base body constructs a through slot. The spring plate extends from a side of the main body into the through slot and constructs a displacement space with the through slot. The protrusion is disposed on the spring plate. A socket is positionable and detachable via the spring plate and the protrusion.

However, an end of the socket assembling to a structure as described above is open. When the structure as described above undergoes a drop test, the socket is easily fallen out from the structure as described above. Furthermore, the structure as described above is easily deformed and destroyed in the drop test. It is necessary to improve structural strength and capability of the structure as described above to have good performance in the drop test.

The present invention has arisen to mitigate and/or obviate the afore-described disadvantages.

SUMMARY OF THE INVENTION

The primary object of the present invention is to provide a display board. The display board of the present invention has a cover member which is assembled to a main body in a first direction and clamps the socket. The cover member and the main body also construct a annular profile with a solid structure. Besides, each ear portion and each engaging slot are engaged with each other to form a strong structure which is hard to be destroyed in a drop test. Moreover, a rib portion is applied to increase structural strength and capability to resist destruction and deformation.

To achieve the above object, a display board in accordance with present invention is for assembling of at least one socket thereto. The display board includes a main body and a cover member. The main body defines a first direction and a second direction which are perpendicular to each other. The main body is formed with a slot recessed along the first direction. Along the second direction the slot is open on a side thereof to form an open side. The slot is substantially C-shaped as viewed in the first direction. The main body further includes at least one assembling portion for the at least one socket to assemble thereto and a hang portion. The at least one assembling portion is disposed on an inner wall of the slot. The cover member is connected with the main body at the open side along the first direction and encloses the open side. The cover member and the main body construct an annular profile. Two opposite ends of the open side are formed with two engaging slots in the first direction respectively. Two opposite ends of the cover member are formed with two ear portions respectively. The two ear portions are engaged respectively with the two engaging slots. The cover member is for the at least one socket to abut thereagainst.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
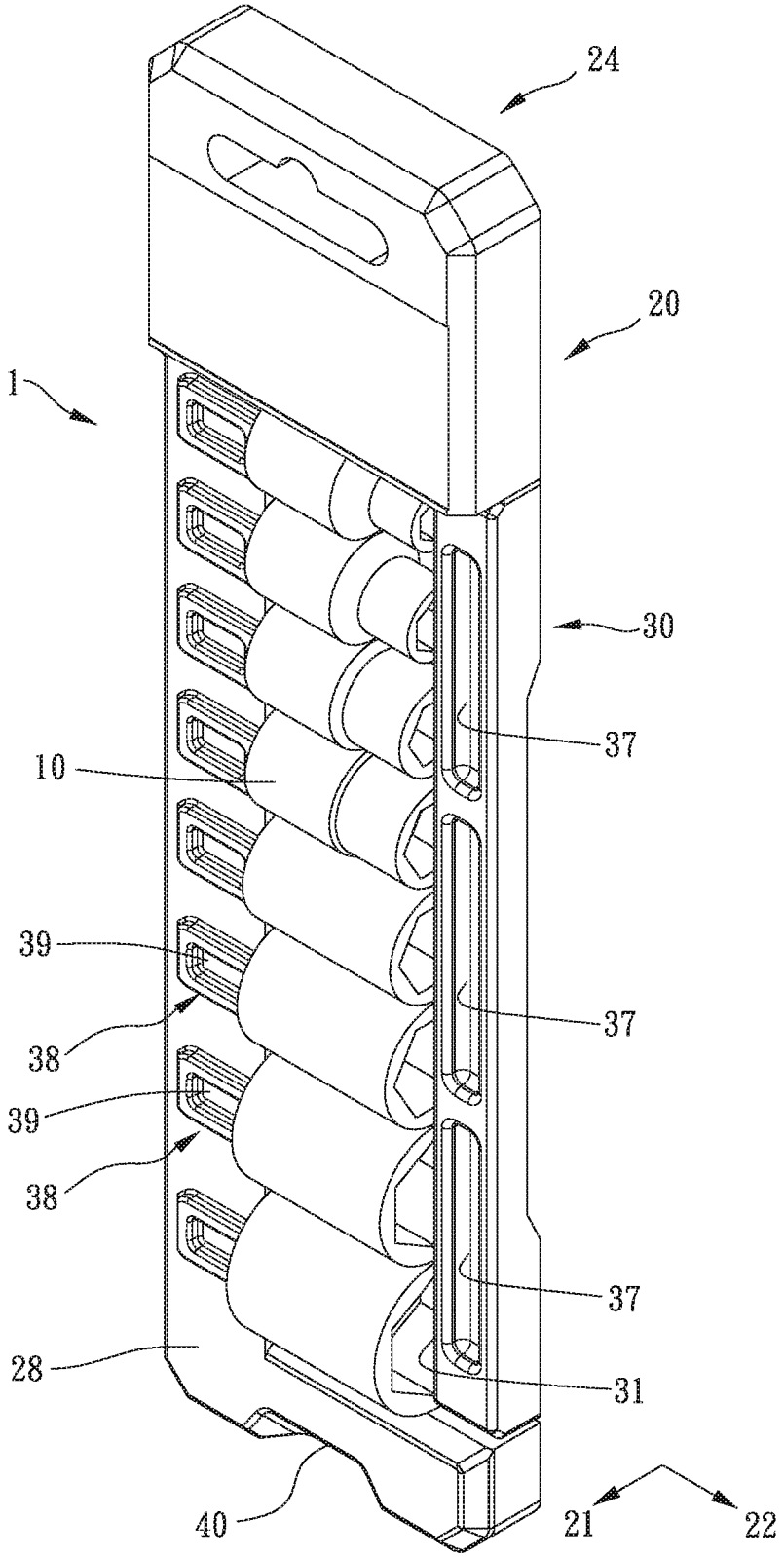
FIG. 1 is a perspective drawing of a preferable embodiment of the present invention.
Figure 2:
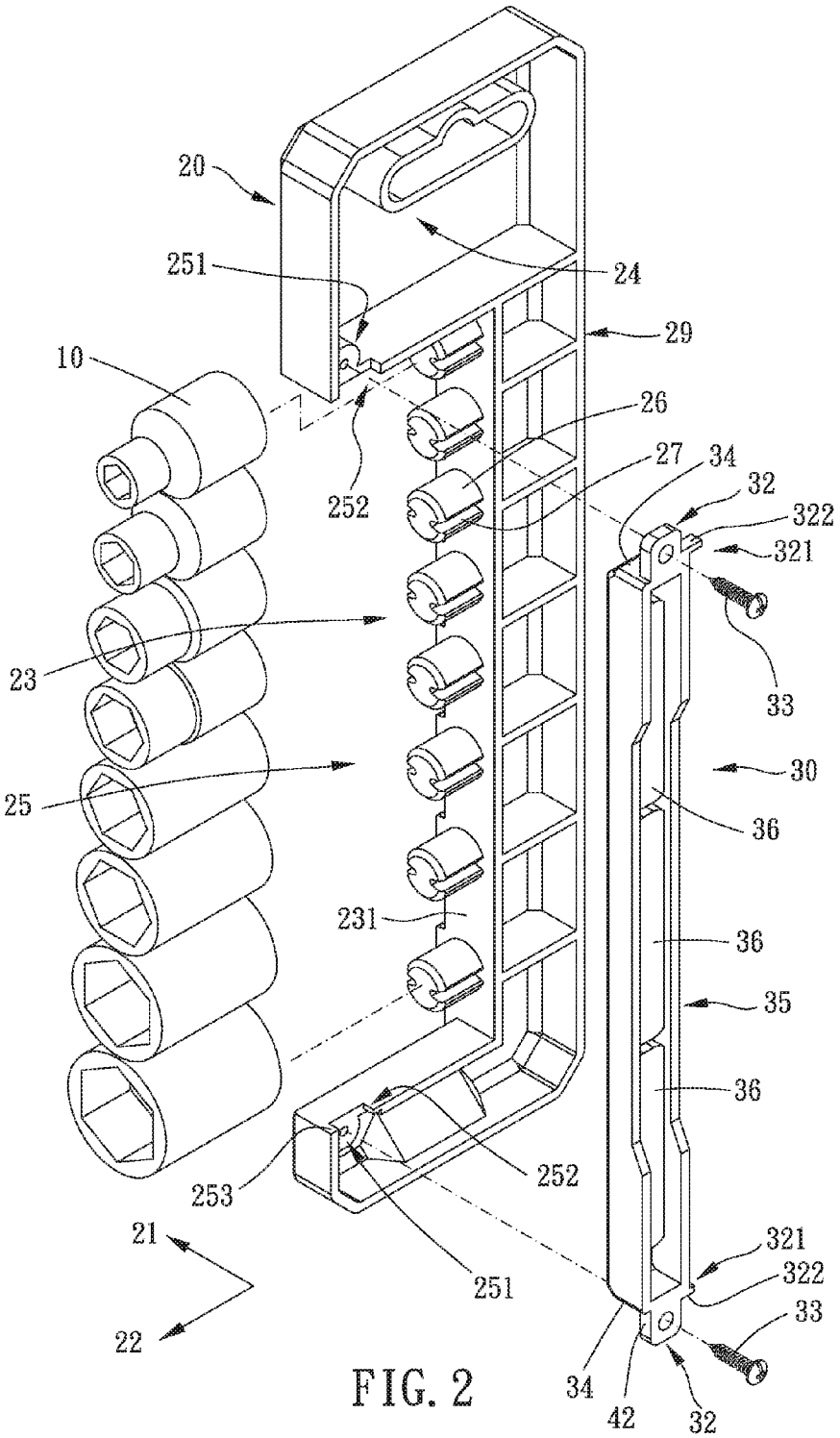
FIG. 2 is a breakdown drawing of the preferable embodiment of the present invention.
Figure 3:
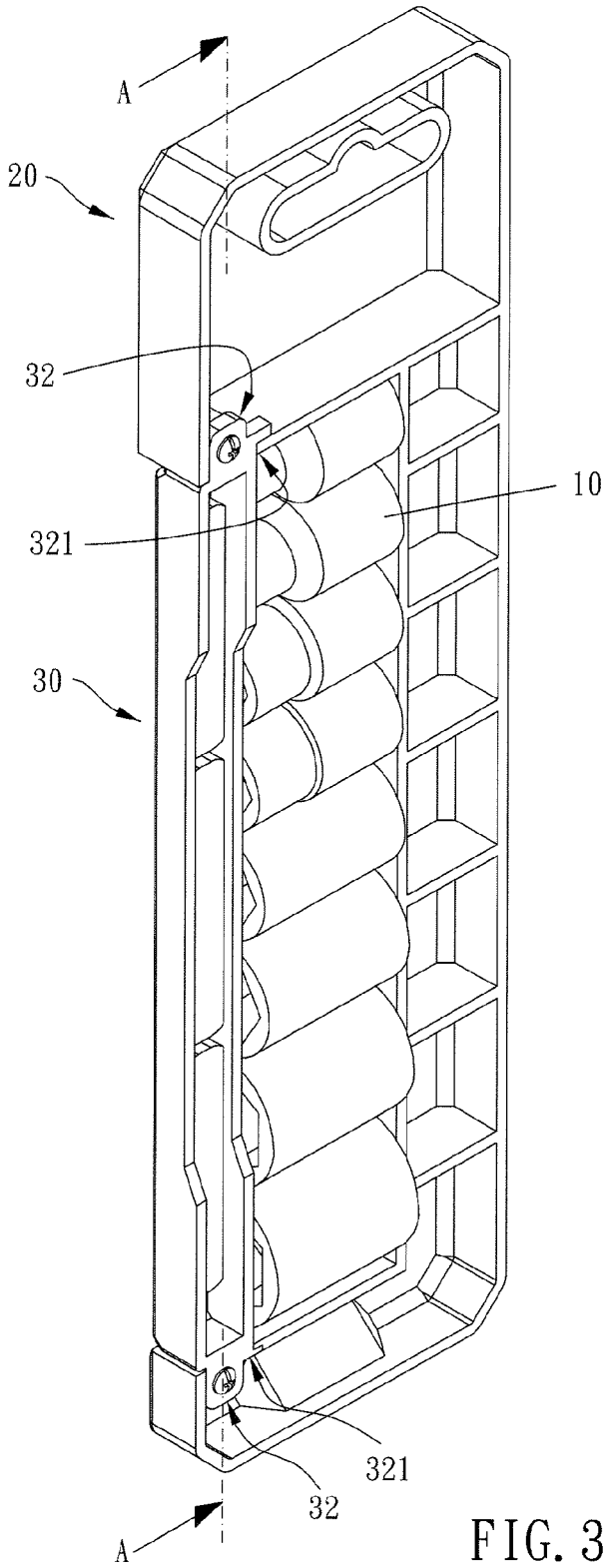
FIG. 3 is another perspective drawing of the preferable embodiment of the present invention.
Figure 4:
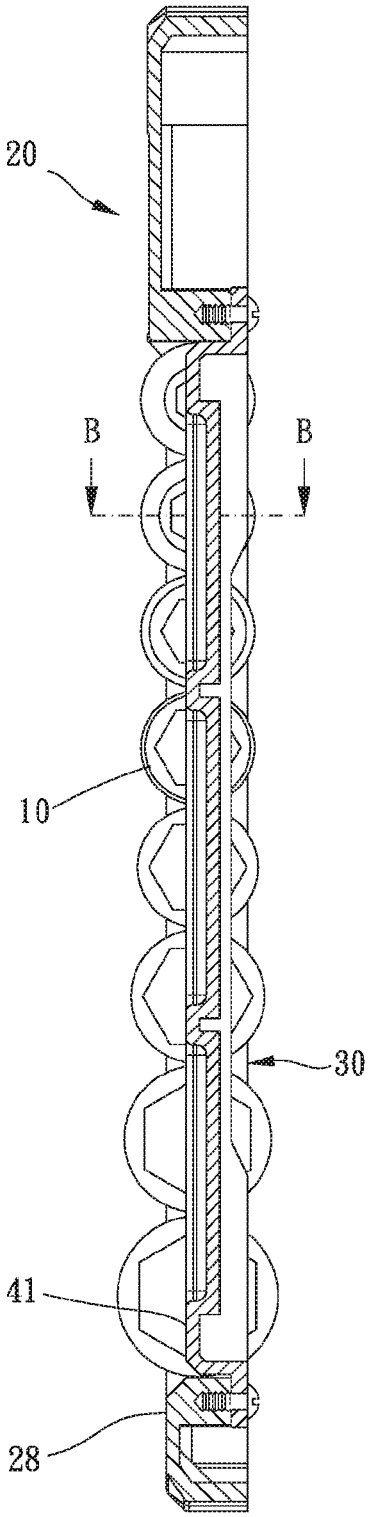
FIG. 4 is a cross-sectional drawing along the line A-A of FIG. 3 of the preferable embodiment of the present invention.
Figure 5:
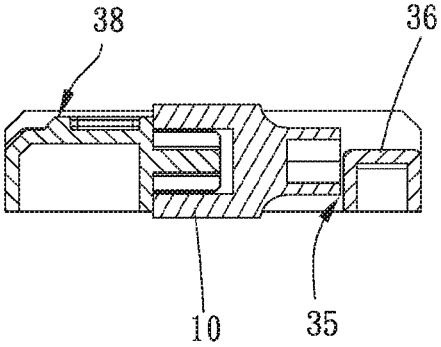
FIG. 5 is a cross-sectional drawing along the line B-B of FIG. 4 of the preferable embodiment of the present invention.

Please refer to FIGS. 1-5, a display board 1 in accordance with a preferred embodiment of the present invention is for assembling of at least one socket 10 thereto. The display board 1 includes a main body 20 and a cover member 30.

The main body 20 defines a first direction 21 and a second direction 22 which are perpendicular to each other. The main body 20 is formed with a slot 23 recessed along the first direction 21 and includes a hang portion 24. In the present embodiment, the slot 23 is penetrated through along the first direction 21. However, the slot 23 can be unpenetrated along the first direction 21 in other embodiments. Along the second direction 22 the slot 23 is open laterally on a side of the main body 20 to form an open side 25. Specifically, the main body 20 is substantially C-shaped as viewed in the first direction 21.

The main body 20 further includes at least one assembling portion 26 for the at least one socket 10 to assemble thereto, and the at least one assembling portion 26 is disposed on an inner wall 231 of the slot 23. The first direction 21 is defined as a thicknesswise direction of the main body 20, and the second direction 22 is defined as a widthwise direction of the main body 20.

Moreover, the assembling portion 26 extends from the inner wall 231 of the slot 23 toward the open side 25 along the second direction 22. The assembling portion 26 includes at least one cut slot 27 open toward the second direction 22 so that the socket 10 can be assembled to the assembling portion 26 from the open side 25. The cut slot 27 provides a space for the assembling portion 26 to deform so that when the socket 10 is assembled to the assembling portion 26, the assembling portion 26 is deformed and tightly abutted against the socket 10.

The cover member 30 is connected with the main body 20 at the open side 25 along the first direction 21 and is transverse to the open side 25. The cover member 30 is for the at least one socket 10 to abut thereagainst. Moreover, the cover member 30 encloses the open side 25, and the cover member 30 and the main body 20 construct an annular profile 31. For example, two opposite ends of the open side 25 are formed with two engaging slots 251 open toward the first direction 21 respectively, and two opposite ends of the cover member 30 are formed with two ear portions 32 respectively. The two ear portions 32 are engaged respectively with the two engaging slots 251.

Moreover, each engaging slot 251 includes a first positioning portion 252, and each first positioning portion 252 is positionably engaged with a second positioning portion 321 of each ear portion 32. When the two ear portions 32 and the two engaging slots 251 are assembled to each other and are engaged via each second positioning portion 321 and each first positioning portion 252, the cover member 30 is positionably engaged with the main body 20. Furthermore, each ear portion 32 is penetrated with a screw member 33, and each screw member 33 is screwed to and fixed to each engaging slot 251 so that the cover member 30 is fixed to the main body 20. Nevertheless, in other embodiments, each ear portion 32 can also be fixed to each engaging slot 251 via clasps or hooks.

Specifically, the cover member 30 further includes two abutting surfaces 34 which are parallel to the second direction 22. Each ear portion 32 protrudes on each abutting surface 34, and the two abutting surfaces 34 are abutted against the inner wall of the slot 23 respectively so that the cover member 30 is much stably fixed to the main body 20. By means as described above, the cover member 30 and the main body 20 construct the annular profile 31 in strong structures, and the cover member 30 and the main body 20 are hard to be destroyed and separated in a drop test.

In practical use, when the cover member 30 is assembled to the main body 20, the cover member 30 also clamps and fixes the socket 10. Moreover, the cover member 30 includes an abutting portion 35 located on a side of the slot 23, and the abutting portion 35 is for the at least one socket 10 to abut thereagainst. Specifically, the cover member 30 includes at least one rib portion 36 which corresponds to the at least one assembling portion 26 and is traverse to the abutting portion 35. The rib portion 36 is for arranging correspondingly to a center of the socket 10. When the abutting portion 35 and the socket 10 are abutted against each other, the rib portion 36 supports on another side of the abutting portion 35 so that the abutting portion 35 is much stably abutted against the socket 10.

The at least one rib portion 36 and the abutting portion 35 construct at least one recessed portion 37, and the cover member 30 is provided with the at least one recessed portion 37 on a side surface facing in the first direction 21. Preferably, the recessed portion 37 provides good stability and structural strength when the cover member 30 clamps and fixes the socket 10. The main body 20 is formed with at least one protruding portion 38 on a side surface facing in the first direction 21. The protruding portion 38 corresponds to the assembling portion 26. Preferably, a side of the protruding portion 38 is for the socket 10 to abut against and increases an abutting area between the main body 20 and the socket 10 to increase stability of assembling the socket 10. The protruding portion 38 further includes a recess 39, and the recess 39 can be used for a label to assemble therewith and to identify the socket 10. A distal end of the main body 20 is formed with a depression 40, and a wall of the depression 40 supports between two side surfaces of the main body 20 and increases capability of the main body 20 to resist deformation and external force. By a design as described above, the display board 1 has much good capability to resist deformation and avoids from destruction and separation during the drop test.

The main body 20 further includes a front displaying face 28 and a back side 29 opposite the front displaying face 28, the two engaging slots 251 are disposed on the back side 29, and a top face 41 of the cover member 30 is lower than the front displaying face 28. Each of the two engaging slots 251 further includes a blocking sidewall 253 which is disposed at the back side 29 and near the open side 25 and faces a lateral side face 42 of one of the two ear portions 32 along the second direction 22, the lateral side face 42 faces away from the at least one assembling portion 26. The first positioning portion 252 is chamfered on the back side 29 of the main body 20, and the second positioning portion 321 includes a lateral projection 322 which projects, in the second direction 22, from one of the two ear portion 32 and away from the blocking sidewall 253. The at least one recessed portion 37 is elongate and narrow and open toward in a direction in which the front displaying face 28 faces.

As a conclusion, the display board of the present invention has the cover member which is assembled to the main body in the first direction and clamps the socket. The cover member and the main body also construct the annular profile with a solid structure. Besides, the ear portion and the engaging slot are engaged with each other to form a strong structure which is hard to be destroyed in the drop test. Moreover, the rib portion increases structural strength and capability to resist destruction and deformation.

While we have shown and described various embodiments in accordance with the present invention, it should be clear to those skilled in the art that further embodiments may be made without departing from the scope of the present invention.

What is claimed is:

1. A display board, for assembling of at least one socket thereto, the display board comprising:

a main body, defining a first direction and a second direction which are perpendicular to each other, the first direction is defined as a thicknesswise direction of the main body, the second direction is defined as a widthwise direction of the main body, the main body being substantially C-shaped as viewed in the first direction and formed with a slot recessed along the first direction, along the second direction the slot being open laterally on a side of the main body to form an open side, the main body further including at least one assembling portion for the at least one socket to assemble thereto and a hang portion, the at least one assembling portion disposed on an inner wall of the slot;

a cover member, connected with the main body at the open side along the first direction and enclosing the open side, the cover member and the main body constructing an annular profile, two opposite ends of the open side formed with two engaging slots open only toward the first direction respectively, two opposite ends of the cover member formed with two ear portions respectively, the two ear portions engaged respectively with the two engaging slots, the cover member being for abutment of the at least one socket;

wherein the main body includes a front displaying face and a back side opposite the front displaying face, the two engaging slots are disposed on the back side, and a top face of the cover member is lower than the front displaying face;

wherein each of the two engaging slots includes a blocking sidewall which is disposed at the back side and near the open side and faces a lateral side face of one of the two ear portions along the second direction, and the lateral side face faces away from the at least one assembling portion.

2. The display board as claimed in claim 1, wherein each ear portion is penetrated with a screw member, and each screw member is screwed to and fixed to each engaging slot.

3. The display board as claimed in claim 1, wherein each engaging slot includes a first positioning portion which is chamfered on the back side of the main body, each first positioning portion is positionably engaged with a second positioning portion of each ear portion, and the second positioning portion includes a lateral projection which projects, in the second direction, from one of the two ear portion and away from the blocking sidewall.

4. The display board as claimed in claim 1, wherein the cover member includes two abutting surfaces which are parallel to the second direction, each ear portion protrudes on each abutting surface, and the two abutting surfaces are abutted against the inner wall of the slot respectively.

5. The display board as claimed in claim 1, wherein the cover member includes an abutting portion located on a side of the slot, and the abutting portion is for the at least one socket to abut thereagainst.

6. The display board as claimed in claim 5, wherein the cover member includes at least one rib portion which corresponds to the at least one assembling portion and is traverse to the abutting portion.

7. The display board as claimed in claim 6, wherein the at least one rib portion and the abutting portion form at least one recessed portion which is elongate and narrow and open toward in a direction in which the front displaying face faces, and the cover member is provided with the at least one recessed portion on a side surface facing in the first direction.

8. The display board as claimed in claim 1, wherein the main body is formed with at least one protruding portion on the front displaying face, the protruding portion corresponds to the assembling portion, the protruding portion includes a recess, the assembling portion extends from the inner wall of the slot toward the open side along the second direction, the assembling portion includes at least one cut slot open toward the second direction, and a distal end of the main body is formed with a depression.

* * * * *